US005615657A

United States Patent [19]

Yoshizawa

[11] Patent Number: 5,615,657

[45] Date of Patent: Apr. 1, 1997

[54] METHOD AND APPARATUS FOR ESTIMATING INTAKE AIR PRESSURE AND METHOD AND APPARATUS FOR CONTROLLING FUEL SUPPLY FOR AN INTERNAL COMBUSTION ENGINE

[75] Inventor: Keita Yoshizawa, Atsugi, Japan

[73] Assignee: UNISIA JECS Corporation, Kanagawa-ken, Japan

[21] Appl. No.: 579,478

[22] Filed: Jan. 4, 1996

[30] Foreign Application Priority Data

Jan. 6, 1995 [JP] Japan ..... 7-000537

[51] Int. Cl.[6] ..... F02D 41/34

[52] U.S. Cl. ..... 123/494; 73/117.3; 123/478

[58] Field of Search ..... 123/478, 480, 123/488, 494; 73/117.3, 118.2; 364/431.05

[56] References Cited

U.S. PATENT DOCUMENTS 5,068,794 11/1991 Hosaka ..... 123/478 X
5,211,150 5/1993 Anzai ..... 123/480
5,215,062 6/1993 Asano et al. ..... 123/480 X
5,270,935 12/1993 Dudek et al. ..... 123/494 X
5,293,553 3/1994 Dudek et al. ..... 123/494 X
5,505,179 4/1996 Brennan ..... 123/479

FOREIGN PATENT DOCUMENTS 64-73133 3/1989 Japan .

*Primary Examiner*—Tony M. Argenbright
*Attorney, Agent, or Firm*—Lowe, Price, LeBlanc & Becker

[57] ABSTRACT

An intake air pressure Pm downstream of a throttle valve of an internal combustion engine is estimated by computation from a basic fuel injection quantity Tp set for an intake air flow rate Q and an engine rotational speed Ne, an intake air temperature TA, and an intake air volumetric efficiency η, according to the equation Pm=C·Tp·TA/η. The estimated intake air pressure Pm is then used in a fuel supply control system wherein the fuel injection pressure from a fuel injection valve is such that a differential pressure relative to atmospheric pressure is constant, to thereby correct the fuel injection period of the fuel injection valve. As a result, there is no requirement for a sensor for detecting intake air pressure. Moreover, since a reference pressure chamber of the pressure regulator can be opened to the atmosphere, piping can be shortened, enabling a more compact unit.

7 Claims, 5 Drawing Sheets

METHOD AND APPARATUS FOR ESTIMATING INTAKE AIR PRESSURE AND METHOD AND APPARATUS FOR CONTROLLING FUEL SUPPLY FOR AN INTERNAL COMBUSTION ENGINE

FIELD OF THE INVENTION

The present invention relates to technology for internal combustion engines incorporating a throttle valve in the intake system, for estimating intake air pressure downstream of the throttle valve, and to technology for controlling the fuel supply quantity, using the estimated intake air pressure downstream of the throttle valve.

BACKGROUND OF THE RELATED ART

Conventionally with electronically controlled fuel injection units for internal combustion engines, a known method for making a fuel injection quantity per unit time of a solenoid type fuel injection valve constant, involves adjusting the fuel pressure supplied to the fuel injection valve using a pressure regulator, and metering the quantity of fuel injected into the engine using a pulse width (a valve open control period of the injection valve) of an injection pulse signal fed to the fuel injection valve.

The pressure regulator is in general disposed in the fuel piping close to the fuel injection valve, and adjusts the fuel quantity returning to the fuel tank by way of a return path, so as to maintain a constant differential pressure between the fuel pressure and the pressure at the injection orifice of the fuel injection valve (engine boost pressure).

In the case where the pressure regulator is disposed in the vicinity of the engine, then the fuel which is returned to the fuel tank for fuel pressure adjustment by the pressure regulator, absorbs heat from the engine, thus causing the temperature inside the fuel tank to rise.

Accordingly a system has been developed wherein the pressure regulator is located inside the fuel tank, so that the fuel is circulated within the fuel tank, thus avoiding a temperature rise therein due to the fuel returning from the pressure regulator.

However, with this construction also where the pressure regulator is provided inside the fuel tank, in order to control the fuel pressure to a predetermined value, it is necessary to take out the pressure of the injection orifice of the injection valve (engine boost pressure), as a reference pressure for the pressure regulator. Hence the long negative pressure piping must be installed for taking the engine boost pressure to the pressure regulator inside the tank.

There is thus the situation where, if the pressure regulator is housed inside the fuel tank, the temperature rise inside the fuel tank can be avoided, and there is no requirement for a long return path for returning the fuel from the pressure regulator to the tank. However, there is instead the requirement for long piping for taking out the boost pressure as a reference pressure, resulting in a deterioration in response, and no real improvement from the point of view of piping construction.

A device has therefore been proposed (refer to Unexamined Japanese Patent Publication No. 64-73133) wherein the negative pressure line is abolished, and the pressure adjustment chamber of the pressure regulator is opened to the atmosphere, thus making the reference pressure atmospheric pressure. Since in this case the fuel injection pressure is adjusted to give a constant differential pressure with the atmospheric pressure as the reference pressure, the differential pressure for the injection orifice is no longer constant. The fuel pressure (or the atmospheric pressure), and the intake air negative pressure (boost pressure) are therefore measured using pressure sensors, and the injection pulse width (fuel injection period) corrected based on the differential pressure therebetween.

However, with such a method using two pressure sensors, the cost is increased.

SUMMARY OF THE INVENTION

The present invention takes into consideration the above problems, with the object of estimating the intake air pressure downstream of the throttle valve of an internal combustion engine, without using a pressure sensor.

Moreover, it is an object to estimate the intake air pressure to a high accuracy.

A further object is to control the fuel supply quantity to a high accuracy, by correcting and setting the fuel supply quantity using the estimated intake air pressure.

Another object is to make a compact fuel supply system by using such a fuel supply quantity control system which uses the estimated intake air pressure.

A method and apparatus according to the present invention for estimating the intake air pressure of an internal combustion engine, therefore includes; detecting (by means of intake an air flow rate detection device and an engine rotational speed detection device) an intake air flow rate and a rotational speed of an internal combustion engine having a throttle valve disposed in an intake air passage, setting (by means of a basic fuel injection quantity setting device) a basic fuel injection quantity Tp, based on the detected engine intake air flow rate and rotational speed, detecting (by means of an intake air temperature detection device) an intake air temperature TA, and computing (by means of an intake air pressure computing device) an estimation value for an intake air pressure Pm downstream of the throttle valve, using the set basic fuel injection quantity Tp, the detected intake air temperature TA, a constant C, and an intake air volumetric efficiency B, according to the following equation:

$$Pm=C\cdot Tp\cdot TA/\eta$$

Operation of the method and apparatus according to the present invention for estimating the intake air pressure is-as follows.

The basic fuel injection quantity Tp is set in proportion to the mass of air drawn into the cylinder. The equation of state for the intake air drawn into the cylinder can therefore be expressed by the following equation; with the cylinder volume as Vc, the intake air pressure after cylinder intake as Pc, the temperature as Tc, and the intake air volumetric efficiency as $\eta$. Here R is a constant.

$$Pc\cdot Vc\cdot\eta=Tp\cdot R\cdot Tc \quad (1)$$

Moreover, from the laws of Boyle-Charles then the following equation can be established for before and after cylinder intake, with the intake air pressure downstream of the throttle valve prior to cylinder intake as Pm, and the temperature as Tm.

$$Pc/Tc=Pm/Tm \quad (2)$$

Therefore, based on equations (1), and (2), the intake air pressure Pm can be estimated from the following equation (3):

$$Pm \approx C \cdot Tp \cdot Tm/\eta \quad (3)$$

(where C is a constant).

The beforementioned intake air volumetric efficiency η can be set (by means of an intake air volumetric efficiency setting means)in accordance with the engine rotational speed.

The intake air volumetric efficiency η, can be simply set to a constant value. However since η changes with engine rotational speed, then the estimation accuracy for the intake air pressure can be increased by accurately setting η in accordance with the engine rotational speed.

A method and apparatus according to the present invention for controlling the fuel supply of an internal combustion engine, wherein fuel which has been adjusted in pressure (by means of a pressure regulator) so that a differential pressure relative to atmospheric pressure is constant, is supplied to a fuel injection valve, and fuel which has been metered by a valve open period of the fuel injection valve is supplied to the internal combustion engine, may include;

detecting (by means of an intake air flow rate detection device and an engine rotational speed detection device) an engine intake air flow rate and a rotational speed, setting (by means of a basic fuel injection period setting device) a basic fuel injection period, based on the detected intake air flow rate and rotational speed, detecting (by means of an atmospheric pressure detection device) the atmospheric pressure or a pressure related to atmospheric pressure, either directly or by estimation, setting (by means of a fuel injection period setting device) a fuel injection period, in accordance with a value which has been obtained by correcting the basic fuel injection period using the detected atmospheric pressure or the pressure related to atmospheric pressure, and the intake air pressure downstream of the throttle valve estimated by means of the intake air pressure estimation method or apparatus according to the present invention, and controlling the fuel supply quantity by opening the fuel injection valve for the set fuel injection period.

The operation of the method and apparatus according to the present invention for controlling the fuel supply quantity of an internal combustion engine is as follows.

Fuel is injected from the fuel injection valve at a pressure which has been adjusted so that a differential pressure relative to atmospheric pressure is constant, and the fuel injection period is corrected in the following manner.

At first, a basic fuel injection period which is set in proportion to a basic fuel injection quantity corresponding for example to the cylinder intake air quantity, based on the engine intake air flow rate and rotational speed.

The basic fuel injection period corresponds to the basic fuel injection quantity, when the fuel supply pressure (the differential pressure across the fuel orifice) is constant (Po). However in practice, the fuel supply pressure adjusted by means of the pressure regulator is adjusted so as to have a constant differential pressure relative to atmospheric pressure, in spite of the fact that the orifice is at a negative intake air pressure. Consequently, the fuel is injected at a fuel pressure which is higher than the constant pressure Po, by the difference in pressure between the atmospheric pressure and the negative intake air pressure at the orifice.

The fuel injection quantity is adjusted to an appropriate quantity by opening the fuel injection valve for a fuel injection period, determined by correcting the basic fuel injection period by means of the detected or estimated atmospheric pressure and the intake air pressure estimated by means of the intake air pressure estimation apparatus.

With such a construction, there is no requirement for the intake air negative pressure piping, nor is there the requirement for the pressure sensor. Hence costs can be reduced, while giving excellent response.

Moreover, the construction maybe such that the pressure regulator is provided inside a fuel tank with the basic pressure chamber for pressure adjustment opened to atmospheric pressure outside of the fuel tank.

If the pressure regulator is provided inside the fuel tank in this manner, then the overall size of the apparatus can be reduced.

DETAILED DESCRIPTION OF THE PREFERRED EMBODIMENTS

A preferred embodiment of the present invention is described hereunder.

Figure 1:
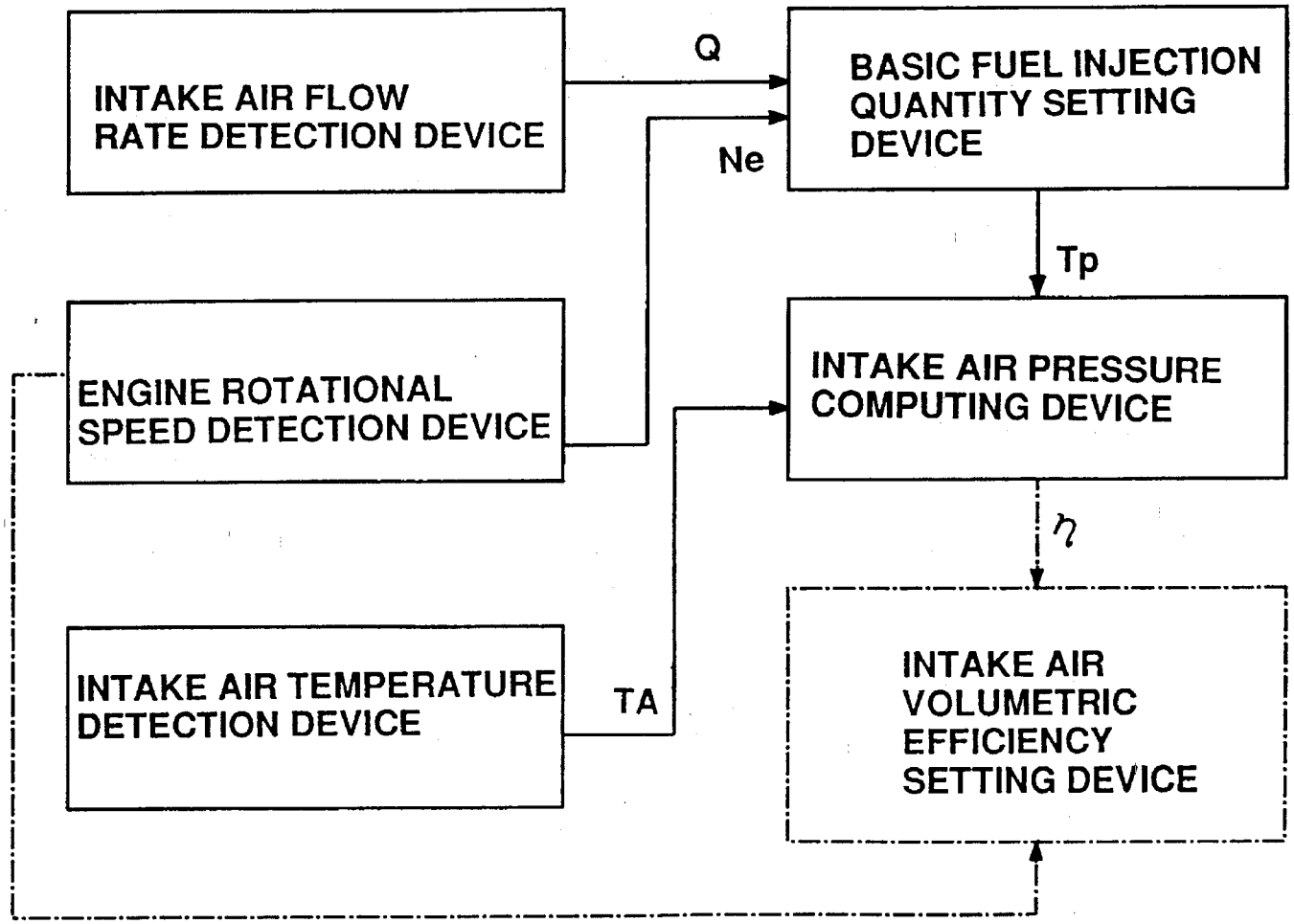
FIG. 1 is a block diagram showing a basic arrangement of an intake air pressure estimation apparatus for an internal combustion engine, according to the present invention.
Figure 2:
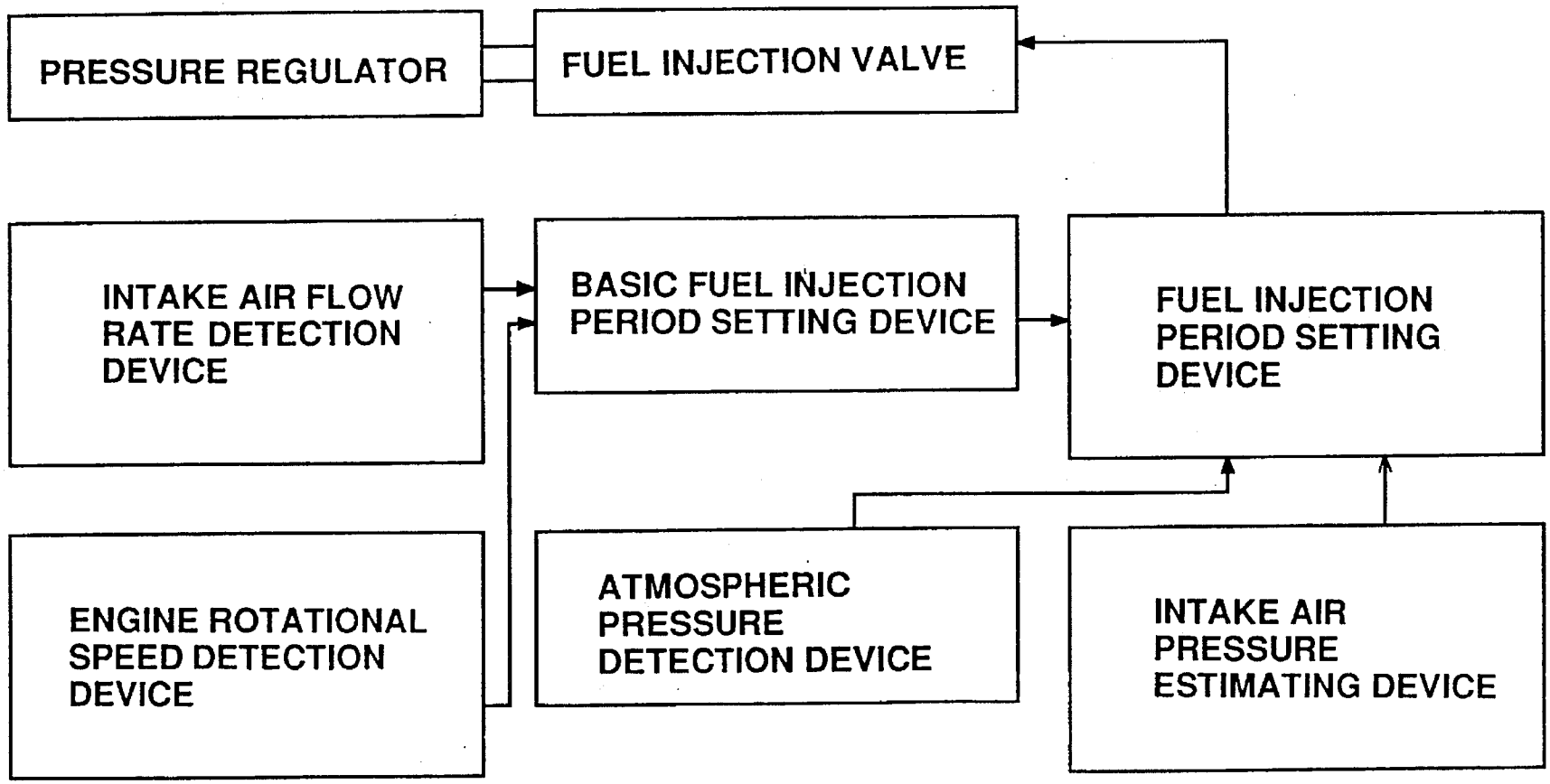
FIG. 2 is a block diagram showing a basic arrangement of a fuel supply control apparatus for an internal combustion engine, according to the present invention.
Figure 3:
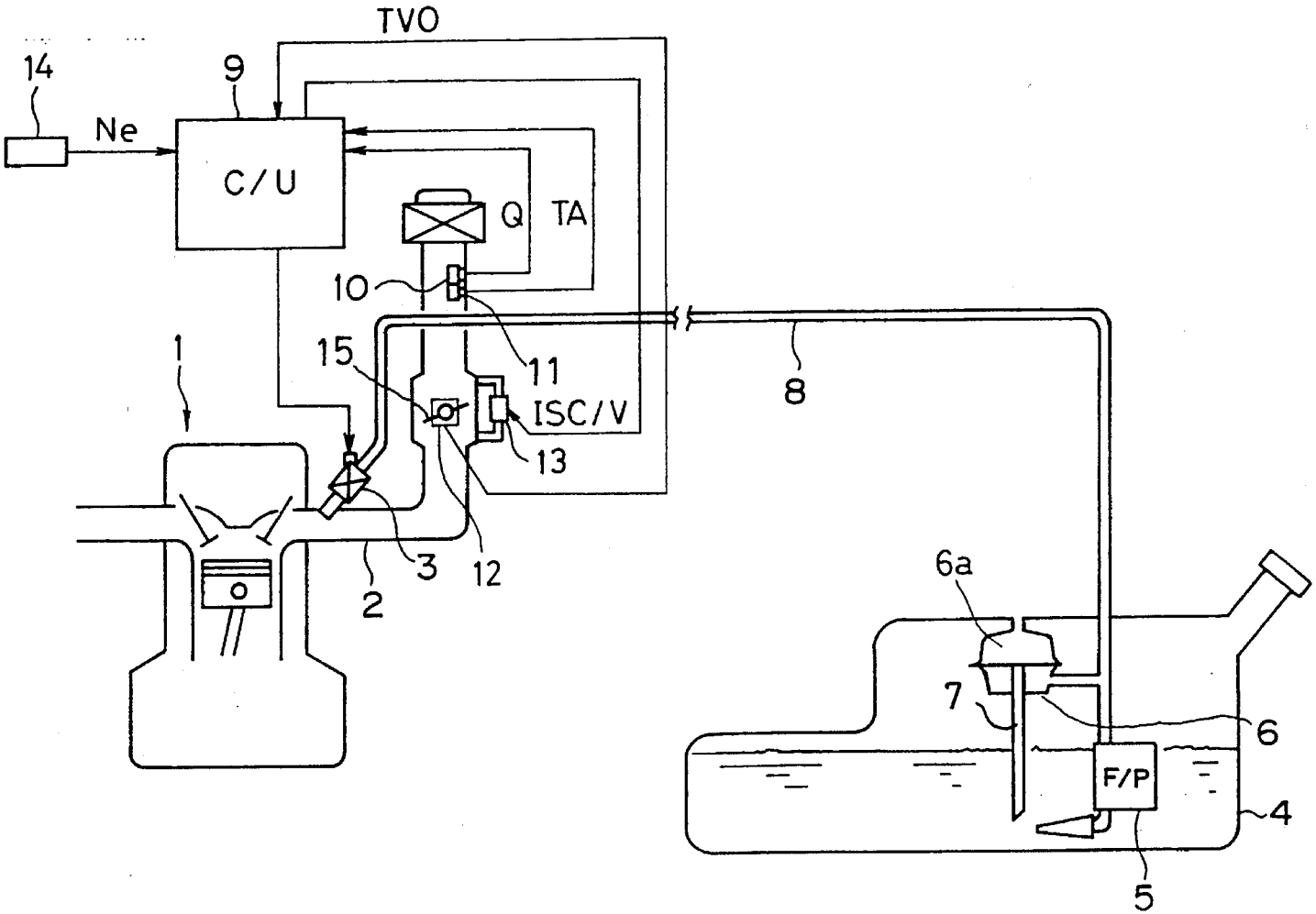
FIG. 3 is a schematic system diagram showing an embodiment.

In FIG. 3 which shows the embodiment, an internal combustion engine 1 has respective branch portions of an air intake manifold 2 provided with fuel injection valves 3.

The fuel injection valves 3 are solenoid type fuel injection valves wherein a valve body which is biased in a valve close direction, is lifted to open by the magnetic attraction from an electromagnetic coil.

Fuel which is pumped out by a fuel pump 5 provided inside a fuel tank 4, is adjusted to a predetermined pressure by means of a pressure regulator 6 provided inside the same fuel tank 4, and then supplied to the fuel injection valves 3.

With the pressure regulator 6, a reference pressure chamber *6a* which is separated from a fuel chamber by means of a diaphragm, is open to atmospheric pressure outside of the fuel tank 4. When a difference between the atmospheric pressure serving as a reference pressure, and the fuel pressure becomes equal to or above a set value, then a return path 7 for returning the fuel to the fuel tank 4 is opened, thereby adjusting to maintain a constant differential pressure.

The fuel which has been subjected to pressure adjustment by the pressure regulator 6, is supplied to the fuel injection valves 3 by way of a fuel supply line 8.

With the above described fuel supply system, the pressure regulator 6 adjusts the pressure by adjusting the fuel quantity returning to the fuel tank 4. Since the fuel is returned to the fuel tank 4 immediately after discharge from the fuel pump 5, it is returned before receiving any heating influence from the engine 1. Therefore there is no rise in temperature inside the fuel tank 4 due to the fuel returning from the pressure regulator 6.

Furthermore, since with the pressure regulator 6 the atmospheric pressure is made the reference pressure, then there is no requirement for the long piping for the case wherein the reference pressure is the engine boost pressure (the pressure at the injection orifice of the injection valves), enabling a saving in piping space, and a reduction in cost.

The power supply to the electromagnetic coil of the fuel injection valves 3 is controlled by an injection pulse signal from a control unit 9, so that fuel is metered and injected in accordance with the pulse width thereof (valve opening control period).

Provided in the engine intake system is an air flow meter 10 for detecting an intake air flow rate Q, a temperature sensor 11 mounted integral with the air flow meter 10 and serving as an intake air temperature detection device for detecting the intake air temperature, a throttle valve 15 for controlling the intake air flow rate, a throttle sensor 12 mounted on the throttle valve 15 for detecting the throttle valve opening TVO, and an idle control valve 13 disposed in a bypass passage bypassing the throttle valve 15, for controlling idle rotational speed by controlling an auxiliary air flow rate at the time of idling. Furthermore, a crank angle sensor 14 is provided for example on the distributor or the cam shaft, for detecting the engine rotational speed Ne.

Figure 4:
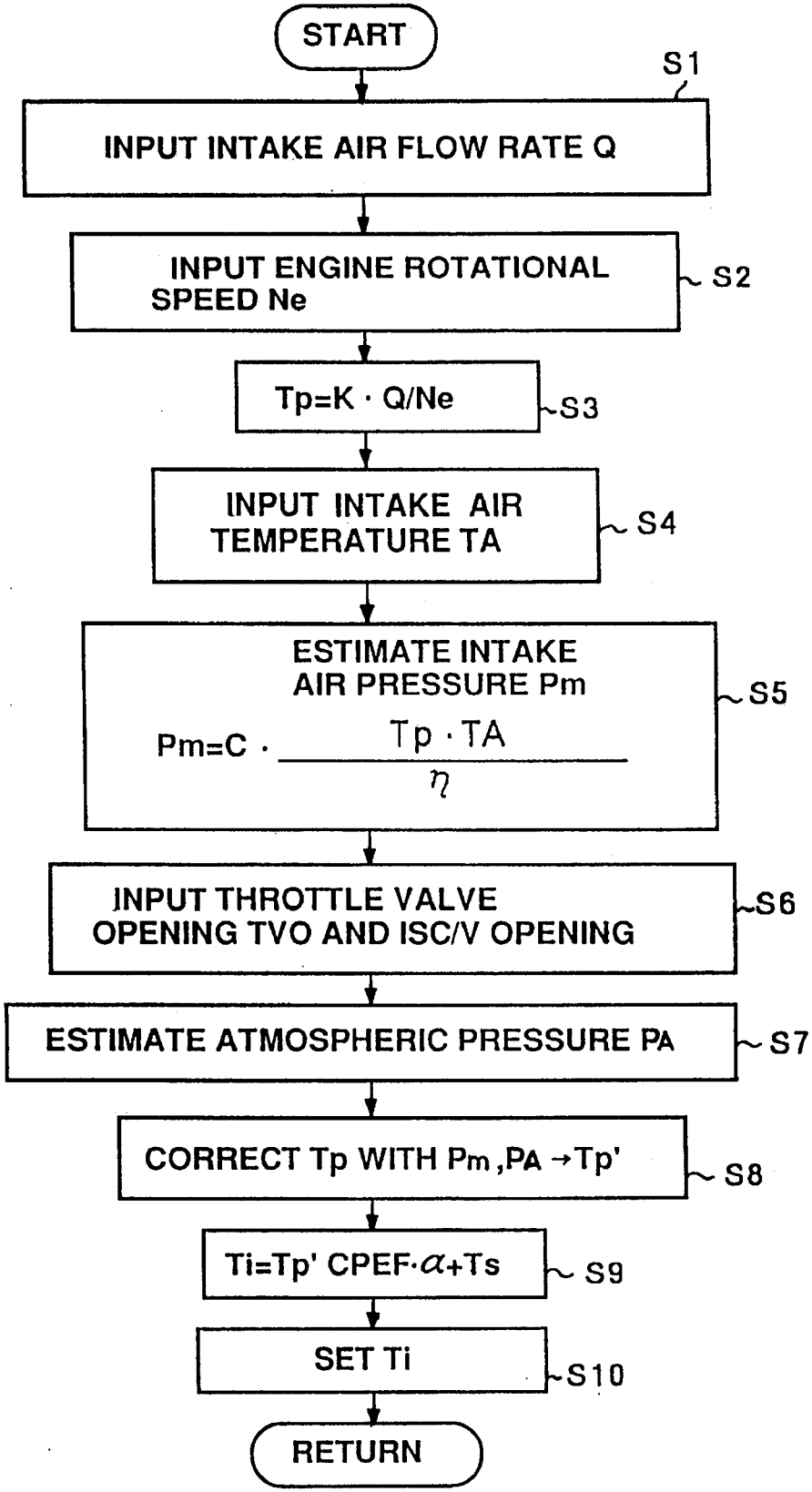
FIG. 4 is a flow chart showing an intake air pressure estimation routine, and an injection pulse width correction routine.

The control unit 9 incorporating a microcomputer, estimates the atmospheric pressure $P_A$ and the intake air pressure Pm downstream of the throttle valve, in accordance with the flow chart shown in FIG. 4, based on detection signals from the beforementioned various sensors, and correctingly sets the pulse width for the fuel injection valves (the valve open period of the fuel injection valves) based on the estimated values.

Explaining the procedure with reference to FIG. 4, in step 3 (with "step" denoted by S in the figure) the basic fuel injection pulse width Tp (=K×Q/Ne; where K is constant), being the basic fuel injection quantity or the basic fuel injection period, is computed based on a signal for the intake air flow rate Q from the air flow meter 10 input in step 1, and a signal for the engine rotational speed Ne from the crank angle sensor 14 input in step 2. Consequently, the functions of step 1 through step 3 embody the basic fuel injection quantity setting device and also constitute the basic fuel injection period setting device.

In step 4, a signal for the intake air temperature TA from the temperature sensor 11 is input.

In step 5, the intake air pressure Pm is estimated by computation based on the basic fuel injection pulse width Tp, the intake air temperature TA, a constant C, and the intake air volumetric efficiency η, according to the following equation:

$$Pm=C\cdot Tp\cdot Tm/\eta$$

Here, for the intake air volumetric efficiency η, a previously set fixed value may be used for simplicity. However since η changes with the engine rotational speed Ne, then if it is set for example by retrieval from a map table, based on the engine rotational speed Ne, it can be obtained to a high accuracy, and further, the estimation accuracy for the intake air pressure Pm is improved.

Next, the atmospheric pressure is detected by estimation. At first in step 6, the throttle valve opening TVO from the throttle sensor 12 is input, together with the opening of the idle control valve 13.

In step 7, the atmospheric pressure is estimated from the above results. To give an outline of the basic estimation method, a total intake air opening area A is obtained from the throttle valve opening TVO and the opening of the idle control valve 13, and an intake air volumetric flow rate $Q_V$ estimated from the relationship between the total intake air opening area A and the engine rotational speed Ne. The atmospheric pressure $P_A$ (air density) can then be estimated based on a ratio of, a value obtained by temperature correcting the volumetric flow rate $Q_V$ using the intake air temperature TA, and the intake air mass flow rate Q detected by the air flow meter 10.

In step 8, the basic fuel injection pulse width Tp is corrected in the following manner, based on the intake air pressure Pm and the atmospheric pressure $P_A$ which have been estimated in the above manner.

Figure 5:
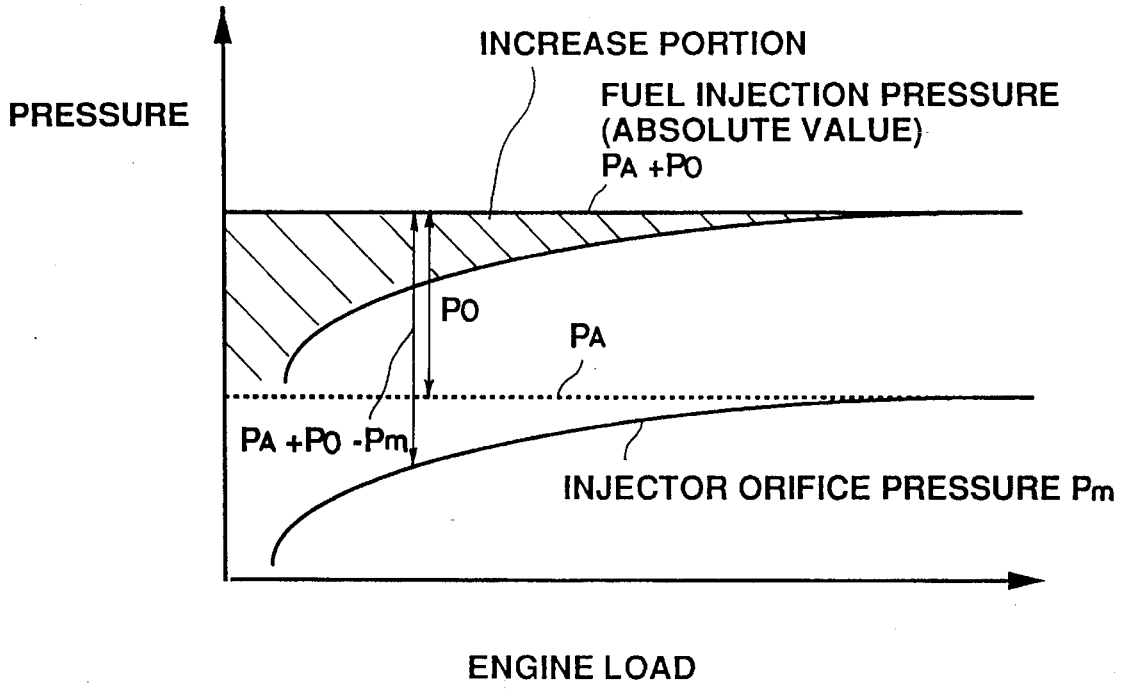
FIG. 5 is a graph showing a relationship between respective pressures and engine load.

The basic fuel injection pulse width Tp is one that has been set as a basic fuel injection period for the case where fuel is injected at a fuel pressure giving a constant differential pressure relative to the intake air pressure Pm at the injector orifice. However when the pressure regulator 6 is used, the fuel pressure is adjusted so that the differential pressure with respect to atmospheric pressure is constant (Po). Consequently, as shown in FIG. 5, the absolute pressure for the fuel injection pressure becomes $P_A$+Po, while the differential pressure relative to the intake air pressure Pm becomes $P_A$+Po−Pm.

More specifically, to correct the basic fuel injection pulse width Tp set for the constant differential pressure Po, so as to obtain the same fuel injection quantity at the actual differential pressure ($P_A$+Po−Pro), then from the relation of; differential pressure x injection period (pulse width)=fuel injection quantity, a basic fuel injection pulse width Tp' for after correction can be set as Tp'=Tp·Po/($P_A$+Po−Pm).

In step 9, the corrected basic fuel injection pulse width Tp', is corrected with, a correction coefficient COEF for correcting for such as water temperature and transient state, an air-fuel ratio feedback correction coefficient α set relative to the air-fuel ratio of the intake air mixture detected for example from oxygen concentration in the exhaust, and an operation delay amount Ts for the fuel injection valve occurring as a result of battery voltage, to thereby give a final fuel injection pulse width Ti computed from the following equation:

$$Ti=Tp\times COEF\times\alpha+Ts$$

If the fuel injection valves 3 are controlled to open based on the injection pulse width Ti set according to the above equation, then the required fuel quantity expressed by the injection pulse width Ti can be injected under the adjusted pressure of the pressure regulator 6.

In step 10, the injection pulse width Ti is set in a register, and at the time of a predetermined injection timing, an injection pulse signal for the injection pulse width Ti is output to the fuel injection valves 3 to thus effect fuel injection.

With such an arrangement, the: intake air pressure Pm and the atmospheric pressure $P_A$ can be estimated without using a pressure sensor. Moreover, correction control of the fuel injection period in a fuel supply apparatus using the pressure regulator 6, and which has been miniaturized by not having intake air pressure as the reference pressure, can be carried out using these estimated pressures. Therefore costs can be significantly reduced. Now, the present embodiment has been shown as one which can also estimate atmospheric pressure. However a construction is also possible wherein the atmospheric pressure is detected directly using a pressure sensor.

Furthermore, with the present embodiment, since the pressure regulator 6 is accommodated within the fuel tank 4, then miniaturization of the fuel supply system is further facilitated.

Although the present invention has been described and illustrated in detail, it should be clearly understood that the same is by way of illustration and example only and is not to be taken by way of limitation, the spirit and scope of the present invention being limited only by the terms of the appended claims.

I claim:

1. A method for estimating the intake air pressure of an internal combustion engine, comprising the steps of:

detecting an intake air flow rate and a rotational speed of an internal combustion engine having a throttle valve disposed in an intake air passage;

setting a basic fuel injection quantity Tp, based on said detected engine intake air flow rate and rotational speed, detecting an intake air temperature TA; and computing an estimation value for an intake air pressure Pm downstream of the throttle valve, using said set basic fuel injection quantity Tp, the detected intake air temperature TA, a constant C, and an intake air volumetric efficiency $\eta$, according to the equation $Pm=C \cdot Tp \cdot TA/\eta$.

2. A method for estimating the intake air pressure of an internal combustion engine according to claim 1, wherein:

said intake air volumetric efficiency $\eta$ is set in accordance with the engine rotational speed.

3. A method for controlling the fuel supply of an internal combustion engine, wherein fuel which has been adjusted in pressure so that a differential pressure relative to atmospheric pressure is constant is supplied to a fuel injection valve, and fuel which has been metered by a valve open period of said fuel injection valve is supplied to the internal combustion engine, said method comprising the steps of:

detecting an engine intake air flow rate and a rotational speed;

setting a basic fuel injection period, based on said detected intake air flow rate and rotational speed;

detecting the atmospheric pressure or a pressure related to atmospheric pressure, by at least one of direct measurement and estimation;

setting a fuel injection period, in accordance with a value which has been obtained by correcting said basic fuel injection period using said detected atmospheric pressure or pressure related to atmospheric pressure, and the intake air pressure downstream of the throttle valve estimated by detecting an intake air flow rate and a rotational speed of an internal combustion engine having a throttle valve disposed in an intake air passage, setting a basic fuel injection quantity Tp, based on said detected engine intake air flow rate and rotational speed, detecting an intake air temperature TA, and computing an estimation value for an intake air pressure Pm downstream of the throttle valve, using said set basic fuel injection quantity Tp, the detected intake air temperature TA, a constant C, and an intake air volumetric efficiency $\eta$, according to the equation $Pm=C \cdot Tp \cdot TA/\eta$; and controlling the fuel supply quantity by opening the fuel injection valve for the set fuel injection period.

4. An apparatus for estimating the intake air pressure of an internal combustion engine, comprising:

intake air flow rate detection means for detecting an intake air flow rate of an internal combustion engine having a throttle valve disposed in an intake air passage;

engine rotational speed detection means for detecting a rotational speed of the engine, basic fuel injection quantity setting means for setting a basic fuel injection quantity Tp, based on said intake air flow rate, and engine rotational speed detected by said respective detection means; and intake air temperature detection means for detecting an intake air temperature TA, and intake air pressure computing means for computing an estimation value for an intake air pressure Pm downstream of the throttle valve, using said set basic fuel injection quantity Tp, the detected intake air temperature TA, a constant C, and an intake air volumetric efficiency $\eta$, according to the equation $Pm=C \cdot Tp \cdot T_A/\eta$.

5. An apparatus for estimating the intake air pressure of an internal combustion engine according to claim 4, further comprising:

intake air volumetric efficiency setting means for setting said intake air volumetric efficiency $\eta$ in accordance with the engine rotational speed.

6. An apparatus for controlling the fuel supply of an internal combustion engine, incorporating a pressure regulator for adjusting a fuel supply pressure so that a differential pressure relative to atmospheric pressure remains constant, and a fuel injection valve to which fuel having said adjusted supply pressure is supplied, for supplying to the internal combustion engine fuel which has been metered by a valve open period, said apparatus comprising:

intake air flow rate detection means for detecting an intake air flow rate of the engine, engine rotational speed detection means for detecting a rotational speed of the engine, basic fuel injection period setting means for setting a basic fuel injection period, based on said intake air flow rate and engine rotational speed detected by said respective detection means;

atmospheric pressure detection means for detecting the atmospheric pressure or a pressure related to atmospheric pressure, either directly or by estimation;

fuel injection period setting means for setting a fuel injection period, in accordance with a value which has been obtained by correcting said basic fuel injection period using said detected atmospheric pressure or the pressure related to atmospheric pressure, and the intake air pressure downstream of the throttle valve estimated by means of the apparatus which includes intake air temperature detection means for detecting an intake air temperature TA, and intake air pressure computing means for computing an estimation value for an intake air pressure Pm downstream of the throttle valve, using said set basic fuel injection quantity Tp, the detected intake air temperature TA, a constant C, and an intake air volumetric efficiency $\eta$, according to the equation $Pm=C \cdot Tp \cdot T_A/\eta$; and fuel injection quantity control means for controlling the fuel injection quantity by opening the fuel injection valve for the fuel injection period set by said fuel injection period setting means.

7. An apparatus for controlling the fuel supply of an internal combustion engine according to claim 6, wherein:

said pressure regulator is provided inside a fuel tank with a basic pressure chamber for pressure adjustment opened to atmospheric pressure outside of the fuel tank.

* * * * *